US005105987A

United States Patent [19]

Quinn et al.

[11] Patent Number: 5,105,987

[45] Date of Patent: Apr. 21, 1992

[54] HOT MELT APPLICATOR HAVING FLEXIBLE RETENTION ELEMENT FOR STORAGE RECEPTACLE

[75] Inventors: Gerald W. Quinn, St. Paul; Craig D. Oster, Oakdale, both of Minn.

[73] Assignee: Minnesota Mining and Manufacturing Company, St. Paul, Minn.

[21] Appl. No.: 614,849

[22] Filed: Nov. 14, 1990

[51] Int. Cl.[5] ..... B67D 5/62

[52] U.S. Cl. ..... 222/146.5; 221/279; 222/389

[58] Field of Search ..... 222/146.2, 146.5, 384, 222/389; 219/229, 230, 421, 424; 221/279

[56] References Cited

U.S. PATENT DOCUMENTS

| | | | |
|---|---|---|---|
| 3,744,921 | 7/1973 | Weller et al. | 222/146.5 X |
| 4,032,046 | 6/1977 | Elliott et al. | 222/146 HE |
| 4,106,668 | 8/1978 | Gebhardt et al. | 221/279 |
| 4,457,457 | 7/1984 | Dziki | 222/146 HE |
| 4,523,705 | 6/1985 | Belanger et al. | 222/146.5 X |
| 4,664,296 | 5/1987 | Dziki | 222/146.5 |
| 4,951,846 | 8/1990 | Oster et al. | 222/146.5 |
| 4,974,752 | 12/1990 | Sirek | 222/146.5 |

*Primary Examiner*—Michael S. Huppert
*Assistant Examiner*—Joseph A. Kaufman
*Attorney, Agent, or Firm*—Gary L. Griswold; Walter N. Kirn; James D. Christoff

[57] ABSTRACT

An applicator for dispensing hot melt adhesives has a receptacle for storing solid blocks of adhesive, along with a feeding mechanism having a movable arm for advancing a single block of adhesive toward a melting chamber. A coil spring element is connected to the arm and unwraps as the arm is advanced in order to retain any remaining blocks of adhesive in the receptacle. At the end of a dispensing operation, the spring exerts just enough force on the arm in a direction away from the melting chamber to relieve pressure against the advanced block, so that the tendency for unwanted molten material to drip from the applicator nozzle is reduced.

10 Claims, 2 Drawing Sheets

HOT MELT APPLICATOR HAVING FLEXIBLE RETENTION ELEMENT FOR STORAGE RECEPTACLE

BACKGROUND OF THE INVENTION

1. Field of the Invention

This invention relates to a hot melt applicator that stores multiple blocks of solid adhesive to be dispensed.

2. Description of the Related Art

Many types of hot melt applicators are adapted for hand-held use so that the molten adhesive can be conveniently maneuvered and placed at a selected location on a workpiece. Conventionally, smaller hand-held hot melt applicators have a manually operated feeding mechanism for pushing a block of solid hot melt material toward a melting chamber. Some of the larger hot melt applicators have an air-operated piston and cylinder assembly for pushing the blocks of hot melt material toward the melting chamber with less operator effort. An improved manually operated feeding mechanism for a hot melt applicator is described in U.S. Pat. No. 4,951,846. U.S. Pat. No. 4,457,457 shows a larger applicator having an air-operated piston and cylinder feeding mechanism.

Some hot melt applicators are provided with a storage receptacle for holding extra blocks of solid hot melt material, so that there is less interruption of the work operation after the first block of material is melted and dispensed. The applicator described in U.S. Pat. No. 4,457,457 has a storage receptacle that is located between and above the melting chamber and the cylinder of the piston and cylinder assembly. As the piston of the applicator in U.S. Pat. No. 4,457,457 is retracted, the next block of solid hot melt material descends through a bottom opening of the receptacle to a position in front of the piston, whereupon the piston can be advanced to push the descended block toward the melting chamber. The piston during advancement also blocks the bottom opening of the receptacle so that the remaining blocks of material in the receptacle are retained in the latter until such time as the piston has completed its advancement and is then withdrawn to its starting position to allow the next block to descend through the opening.

However, there is a continuing desire to reduce the overall size of hot melt applicators as much as feasible in order to improve the maneuverability of the applicator as well as the operator's vision of the work operation, especially in instances where the molten adhesive must be placed at a precise location on the workpiece. While the applicator shown in U.S. Pat. No. 4,457,457 has provided satisfactory performance, the piston and cylinder assembly extends behind the storage receptacle a significant distance which is somewhat greater than the length of the blocks to be dispensed, and additional space is also consumed by the pressurized air connection at the rearmost end of the cylinder. The piston and cylinder assembly may also inhibit rearward movement of the block as the front portion of the block expands in the melting chamber after a dispensing operation, possibly causing unwanted molten adhesive to drip from the applicator's nozzle.

SUMMARY OF THE INVENTION

The present invention concerns an applicator for dispensing molten material from elongated blocks of solid material, and comprises a frame along with a melting chamber that is connected to the frame and that is adapted to receive and melt an elongated block of solid material. The applicator includes a receptacle for storing at least one elongated block of solid material, and the receptacle includes a lower opening. A feeding mechanism is connected to the frame for advancing a block of solid material from a position beneath the opening and along a path toward the melting chamber. The applicator also includes an element movable along the opening from a first position enabling a block of material to pass through the opening and toward a second position for preventing a block of solid material in the receptacle from passing through the opening. The element is flexible and movable along a non-straight path when moving from the first position to the second position. As such, reduction in the size of the applicator is facilitated.

DETAILED DESCRIPTION OF THE PREFERRED EMBODIMENT

Figure 1:
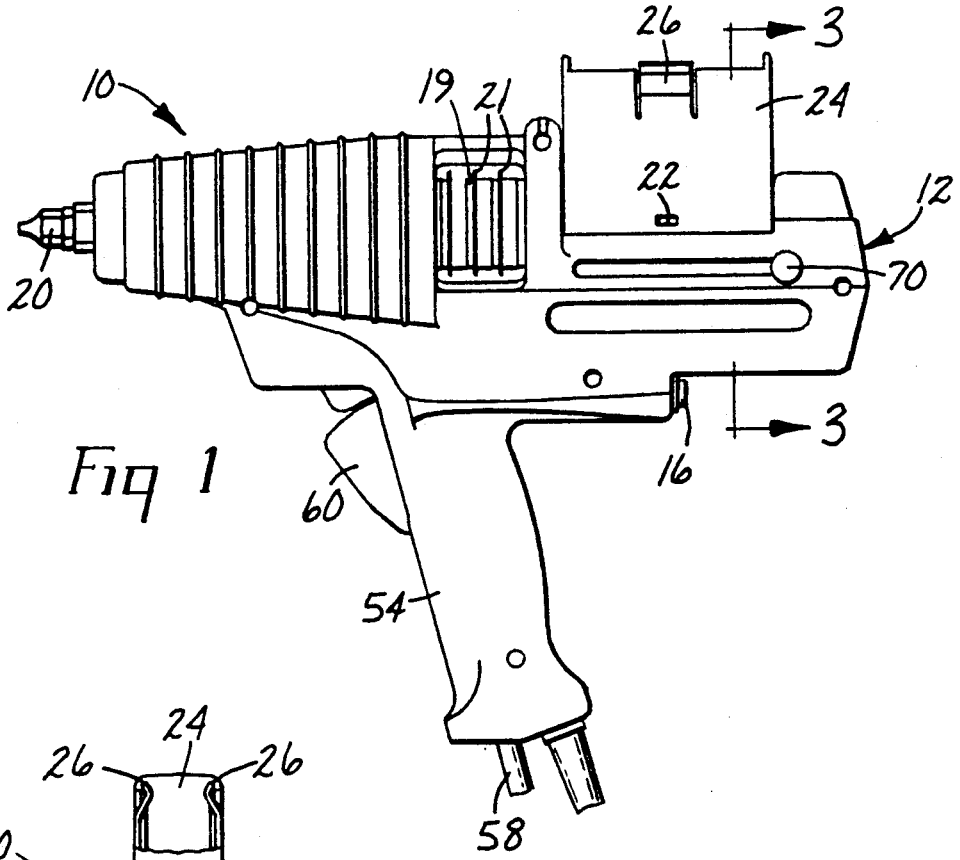
FIG. 1 is a side elevational view of the applicator of the present invention.

An applicator 10 for dispensing molten material such as hot melt adhesive is shown in FIGS. 1–5 and includes a frame 12 that is in the nature of a two piece, molded housing. A melting chamber 14 (see FIG. 4) includes a pair of internal electrical resistance heating elements that are activated by a switch 16. An entrance 18 leads to a somewhat conical cavity in the melting chamber 14, and molten adhesive exits the melting chamber 14 through a nozzle 20 for application to the work site.

A sleeve 19 is supported by the frame 12 immediately behind the entrance 18 to the melting chamber 14, and functions to align the adhesive block during its travel through the entrance 18 and into the melting chamber 14. The sleeve 19 carries a number of spaced apart, ring-shaped cooling flanges 21 to substantially prevent melting of portions of the adhesive block that are adjacent the entrance 18 but outside of the melting chamber 14.

The frame 12 has a pair of oppositely extending tabs 22, one of which is shown in FIG. 1. The tabs 22 are received in square apertures formed in lower wall portions of a rectangular, box-like storage receptacle 24. The receptacle 24 may be detached from the frame 12 for access to areas below when the lower wall portions of the receptacle 24 are flexed outwardly a sufficient distance to allow the apertures to clear the tabs 22.

Figure 2:
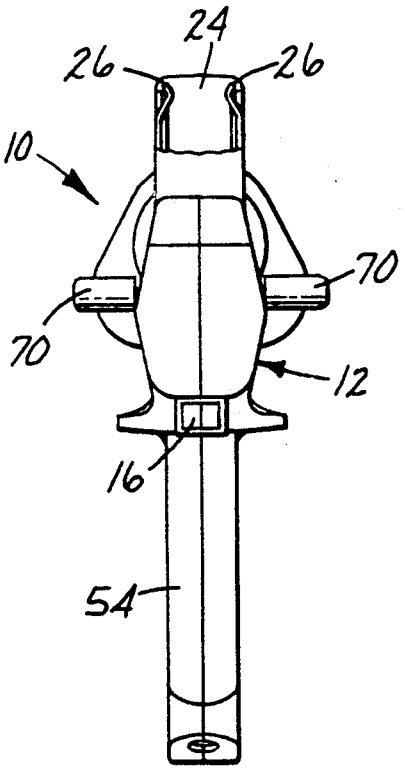
FIG. 2 is a rear elevational view of the applicator shown in FIG. 1.

The top of the receptacle 24 has a pair of curved, inwardly extending fingers 26 (see, e.g., FIG. 2). The receptacle 24 is integrally molded of a plastic material having sufficient flexibility to enable the fingers 26 to deflect outwardly and away from each other when a cylindrical block 28 of solid thermoplastic material such as hot melt adhesive (see FIGS. 4–5) is pushed through the open top of the receptacle 24.

The applicator 10 also includes a feeding mechanism broadly designated 30 that is connected to the frame 12 for advancing the block 28 toward the melting chamber 14. The feeding mechanism 30 includes an upright arm 32 that is reciprocally movable in a horizontal direction viewing FIGS. 1, 4 and 5. The arm 32 has a disk-like head 34 located beneath the receptacle 24 for advancing the block 28 that has descended through a lower opening 36 of the receptacle 24. The head 34 pushes the block 28 from a position beneath the opening 36 and along a path toward the melting chamber 14. A front face of the head 34 is inclined in a downward and rearward direction in order to facilitate horizontal movement of the block 28 toward the melting chamber 14 even in instances where cantilever forces tend to pivot the arm 32 counterclockwise (viewing FIGS. 4–5) as the arm 32 is advanced by the piston rod 50.

Figure 3:
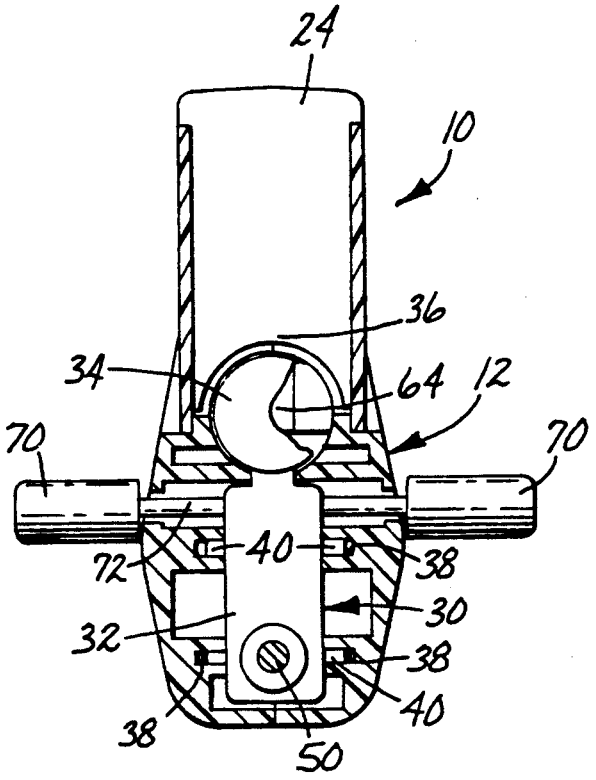
FIG. 3 is an enlarged cross-sectional view of the applicator taken along lines 3—3 of FIG. 1.
Figure 4:
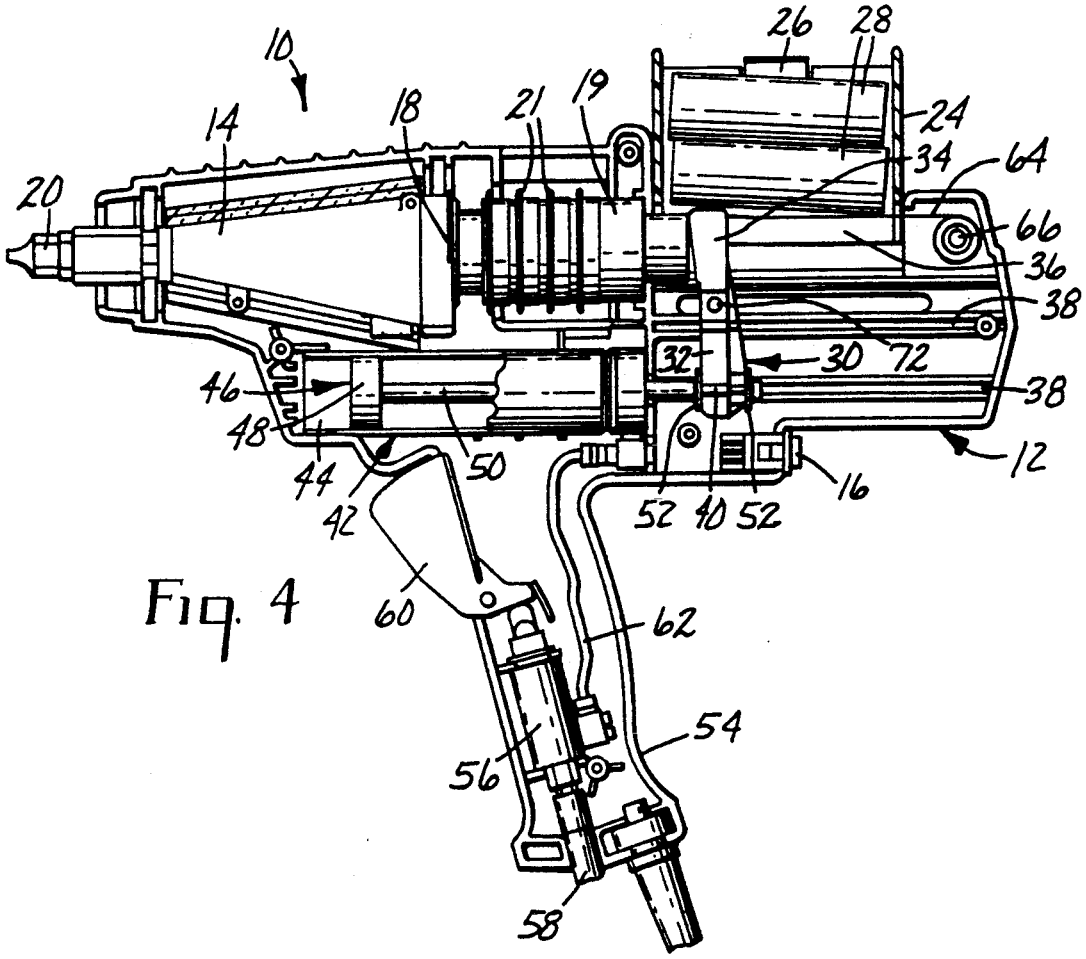
FIG. 4 is an enlarged side view in partial section of the applicator shown in FIG. 1 along with blocks of solid material, wherein an arm of the applicator has been advanced to push one of the blocks toward a melting chamber while a flexible element connected to the arm retains additional blocks in an overlying storage receptacle.
Figure 5:
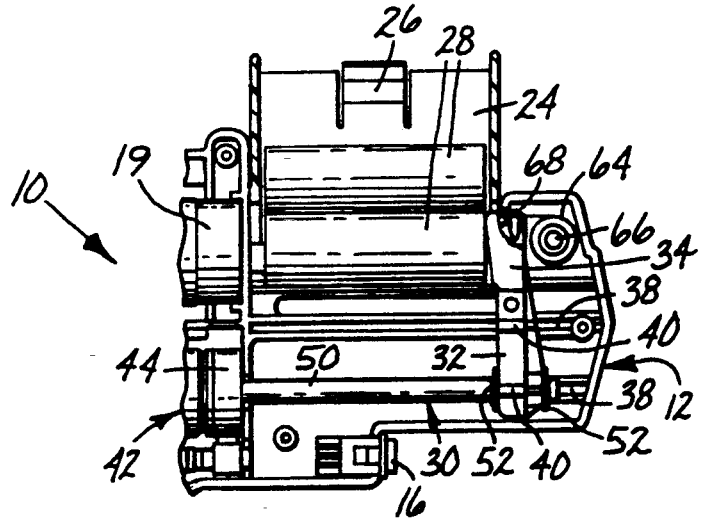
FIG. 5 is a fragmentary view somewhat similar to FIG. 4 except that the arm and element have been retracted to allow the next block of solid material in the receptacle to descend to a position in front of the arm.

Opposite sides of the frame 12 each include a pair of parallel channels 38 that are shown in FIGS. 3–5. The lower portion of the arm 32 includes two pairs of opposed, outwardly extending guides 40 which each slide in a respective one of the channels 38 as the head 34 moves either toward or away from the melting chamber 14.

The feeding mechanism 30 includes an air-powered piston and cylinder assembly 42 having a cylinder 44 that is fixed to the frame 12 in a position directly underlying the melting chamber 14 and the sleeve 19. A piston 46 of the assembly 42 includes a piston head 48 that is reciprocal within the cylinder 44, along with a piston rod 50 that extends in a rearward direction and has an outer end that passes through a hole formed in a lower portion of the arm 32. A lock ring and washer assembly 52 is coupled to the rod 50 on each side of the arm 32 to secure the arm 32 to the piston 46 for simultaneous movement.

A handle 54 of the frame 12 carries an air valve 56 coupled by tubing 58 to a source of pressurized air (not shown). A lever 60 is pivotally connected to the handle 54 and, when depressed, opens the air valve 56 to communicate the tubing 58 with a length of tubing 62 that extends between the air valve 56 and the rear end of the cylinder 44 in order to admit pressurized air into the latter. As the cylinder 44 is pressurized, the piston head 48 moves to the left (viewing FIG. 4), thereby retracting the rod 50 and simultaneously moving the arm 32 to the left such that the head 34 of the arm 32 moves the block 28 along a path toward the melting chamber 14.

Referring now to FIGS. 4 and 5, the applicator 10 includes a flat, constant force coil spring element 64 having one end portion that is loosely wrapped around a post 66 of the frame 12. The opposite end portion of the spring element 64 has a hole, and a headed pin 68 (see FIG. 5) passes through the hole to secure the element 64 to the top of the head 34 of the arm 32. By comparing FIGS. 4 and 5, it can be observed that as the arm 32 moves to the left during pressurization of the cylinder 44 in order to push the block 28 toward the melting chamber 14, the spring element 64 unwraps and is therefor movable along a curved, non-straight path from a first or coiled position as shown in FIG. 5 to a second or partially unwrapped position as shown in FIG. 4. As the element 64 unwinds and approaches the second position, the uncoiled portion of the spring element 64 supports the blocks 28 remaining in the receptacle 24 to prevent such blocks 28 from descending by gravity through the lower opening 36 of the receptacle 24.

Once the arm 32 has approached its limit of forward movement and the trailing end of the block 28 pushed by the arm 32 is forward of the receptacle 24, retraction of the arm 32 and spring element 64 to their respective positions shown in FIG. 5 enables the next block 28 in the receptacle 24 to drop through the opening 36 into a position in front of the head 34 aligned with the central axis of the melting chamber 14. The operation is then repeated by depressing the lever 60 to pressurize the cylinder 44 in order to again advance the arm 32 and block 28, while the spring element 64 again unwraps to support any blocks 28 remaining in the receptacle 24.

A pair of opposed grips 70 (FIGS. 1–3) are secured to a bar 72 (FIG. 3) that extends through the arm 32, for enabling the operator to retract the arm 32 to its position shown in FIG. 5 when desired and allow another block 28 to descend through the opening 36. The spring element 64, comprising a resilient metal flat coil spring, is inherently biased in a manner to urge the arm 32 away from the melting chamber 14. The bias of the spring element 64 is not sufficient to pull the arm 32 along with the piston rod 50 back to their respective positions shown in FIG. 5 when the operator releases the lever 60 to relieve pressure of air in the cylinder 44, so that the arm 32 need not travel great distances before again contacting the block 28 and applying pressure to the same for advancement during the next dispensing operation. However, the bias of the spring element 64 is sufficient to just slightly move the arm 32 to the right viewing FIGS. 4 and 5, thereby relieving the pressure of the arm 32 on the block 28 in order to help avoid drippage of molten material from the nozzle 20. The latter feature is especially desirable because material remaining in the melting chamber 14 after a dispensing operation may continue to expand and otherwise cause unwanted molten material to drip from the nozzle 20.

As can be appreciated, the use of a flexible element such as element 64 is advantageous in that little space behind the receptacle 24 is needed, and thus the reduction in overall length of the applicator is facilitated. The piston and cylinder assembly 42, being conveniently located below the melting chamber 14 and the sleeve 19, are normally out of the operator's line of sight to the workpiece. As such, the applicator 10 is both maneuverable and compact.

We claim:

1. An applicator for dispensing molten material from elongated blocks of solid material comprising:

a frame;

a melting chamber connected to said frame and adapted to receive and melt an elongated block of solid material;

a receptacle connected to said frame for storing at least one elongated block of solid material, said receptacle including a lower opening;

a feeding mechanism connected to said frame for advancing a block of solid material from a position beneath said opening and along a path toward said melting chamber; and an element connected to said feeding mechanism, said element being movable along said opening from a first position enabling a block of solid material to pass through said opening and toward a second position for preventing a block of solid material in said receptacle from passing through said opening, said element being flexible and movable along a non-straight path when moving from said first position to said second position.

2. The applicator of claim 1, wherein said element is a spring.

3. The applicator of claim 2, wherein said element is a coil spring.

4. The applicator of claim 3, wherein said element is a flat coil spring.

5. The applicator of claim 1, wherein said opening is located between said melting chamber and said element when said element is in said first position.

6. The applicator of claim 1, wherein said feeding mechanism includes a movable arm for pushing a block of solid material toward said melting chamber, and wherein said element is connected to said arm.

7. The applicator of claim 6, wherein the frame includes a channel, and wherein said arm slides along said channel when pushing a block of solid material toward said melting chamber.

8. The applicator of claim 6; and including a piston and cylinder assembly for moving said arm, wherein said cylinder is located beneath said melting chamber.

9. The applicator of claim 1, wherein said feeding mechanism includes a movable arm for pushing a block of solid material toward said melting chamber, and wherein said element is a coil spring having an end portion connected to said arm, said spring being biased in a manner to urge said arm away from said melting chamber.

10. An applicator for dispensing molten material from elongated blocks of solid material comprising:

a frame;

a melting chamber connected to said frame and adapted to receive and melt an elongated block of solid material;

a receptacle connected to said frame for storing at least one elongated block of solid material, said receptacle including a lower opening;

a feeding mechanism connected to said frame for advancing a block of solid material from a position beneath said opening and along a path toward said melting chamber; and an element movable with said feeding mechanism, said element being movable along said opening from a first position enabling a block of solid material to pass through said opening and toward a second position for preventing a block of solid material in said receptacle from passing through said opening, said element being flexible and movable along a non-straight path when moving from said first position to said second position.

* * * * *